US009305696B2

(12) United States Patent
Kuo et al.

(10) Patent No.: US 9,305,696 B2
(45) Date of Patent: Apr. 5, 2016

(54) STACKED INDUCTOR

(71) Applicant: Alliance Magnetics (H.K.) Co. LTd., Kwai Chung, N.T. (CN)

(72) Inventors: Martin Kuo, New Taipei (TW); Andrew Chu, Ruijin (CN)

(73) Assignee: ALLIANCE MAGNETICS (H.K.) CO. LTD., Hong Kong (CN)

( * ) Notice: Subject to any disclaimer, the term of this patent is extended or adjusted under 35 U.S.C. 154(b) by 129 days.

(21) Appl. No.: 14/325,545

(22) Filed: Jul. 8, 2014

(65) Prior Publication Data

US 2016/0012955 A1 Jan. 14, 2016

(51) Int. Cl.

| | |
|---|---|
| ***H01F 27/24*** | (2006.01) |
| ***H01F 17/04*** | (2006.01) |
| ***H01F 27/28*** | (2006.01) |
| ***H01F 27/26*** | (2006.01) |

(52) U.S. Cl.

CPC ..... *H01F 27/266* (2013.01)

(58) Field of Classification Search

CPC ..... H01F 27/292; H01F 17/0033; H01F 2027/2857; H01F 5/04

USPC ..... 336/212, 221, 222, 223

See application file for complete search history.

(56) References Cited

U.S. PATENT DOCUMENTS 3,747,038 A * 7/1973 McGill ..... H01F 29/025 29/605
4,901,048 A * 2/1990 Williamson ..... H01F 27/2847 336/180
4,939,451 A * 7/1990 Baran ..... G01R 15/183 324/126
5,027,059 A * 6/1991 de Montgolfier .... G01R 15/146 324/126
5,917,401 A * 6/1999 Smith ..... G01R 1/203 29/610.1
6,160,467 A * 12/2000 Teimorzadeh ..... H01F 27/2852 336/180
6,927,667 B1 * 8/2005 Busletta ..... H01F 17/045 336/180
7,248,139 B1 * 7/2007 Podlisk ..... H01F 27/2847 336/232
8,072,305 B2 * 12/2011 Nakahori ..... H01F 27/2804 336/200
8,350,659 B2 * 1/2013 Dziubek ..... H01F 27/303 336/205
8,410,889 B2 * 4/2013 Garrity ..... H01F 27/2847 336/172
8,917,156 B2 * 12/2014 Garrity ..... H01F 27/2847 336/172
2009/0302986 A1 * 12/2009 Bedea ..... H01F 27/34 336/55

* cited by examiner

*Primary Examiner* — Alexander Talpalatski
*Assistant Examiner* — Joselito Baisa
(74) *Attorney, Agent, or Firm* — Jackson IPG PLLC; Demian K. Jackson

(57) ABSTRACT

A stacked inductor is provided with a conductive frame including a top surface, two side surfaces depending downward from the top surface, two spaced bottom surfaces each inward bending from a bottom of either side surface, an upper space defined by the top surface, the side surfaces, and the bottom surfaces, two vertical legs each depending downward from either bottom surface, two supports each inward bending from a bottom of either leg, and a lower space defined by the bottom surfaces, the legs, and the supports; an upper core including a bottom groove; an intermediate core; and a lower core including a top groove. The bottom groove is on the top surface, the intermediate core is in the upper space, the lower core is in the lower space and supported by the supports. The upper, intermediate, and lower cores are magnetically connected together.

2 Claims, 4 Drawing Sheets

STACKED INDUCTOR

BACKGROUND OF THE INVENTION

1. Field of the Invention

The invention relates to inductors and more particularly to a stacked inductor with improved characteristics.

2. Description of Related Art

A conventional stacked inductor includes a first inductor including first coils each disposed within a different one of conductive layers. The first coils are vertically stacked and concentric to a vertical axis. The stacked inductor further includes a second inductor having second coils each disposed within a different one of the conductive layers. The second coils are vertically stacked and concentric to the vertical axis. Within each conductive layer, the coil is disposed within an inner perimeter of the first coil.

Notwithstanding the prior art, the invention is neither taught nor rendered obvious thereby.

SUMMARY OF THE INVENTION

It is therefore one object of the invention to provide a stacked inductor comprising a conductive frame including a top surface, two side surfaces depending downward from both sides of the top surface, two spaced bottom surfaces each inward bending about 90-degree from a projecting portion of a bottom of either side surface, an upper space defined by the top surface, the side surfaces, and the bottom surfaces, two vertical legs each depending downward from one end of either bottom surface, two supports each inward bending about 90-degree from a bottom of either leg, and a lower space defined by the bottom surfaces, the legs, and the $1^{st}$ supports; an upper core including a bottom groove; an intermediate core; a lower core including a top groove; a first member; and a second member; wherein the bottom groove of the top core is disposed on the top surface, the intermediate core is disposed in the upper space, the first member is disposed between the intermediate core and the top surface, the lower core is disposed in the lower space and supported by the supports, and the second member is disposed between the intermediate core and the bottom surfaces; and wherein the upper core, the intermediate core, and the lower core are magnetically connected together.

The invention has the following advantages: The inductor has higher inductance at light load which boosts the light-load efficiency majorly. The same inductor will have lower inductance at full load to improve the transient.

The above and other objects, features and advantages of the invention will become apparent from the following detailed description taken with the accompanying drawings.

The Major advantage is that the inductor has higher inductance at light load which boosts the light-load efficiency majorly. The same inductor will have lower inductance at full load to improve the transient.

DETAILED DESCRIPTION OF THE INVENTION

Figure 1:
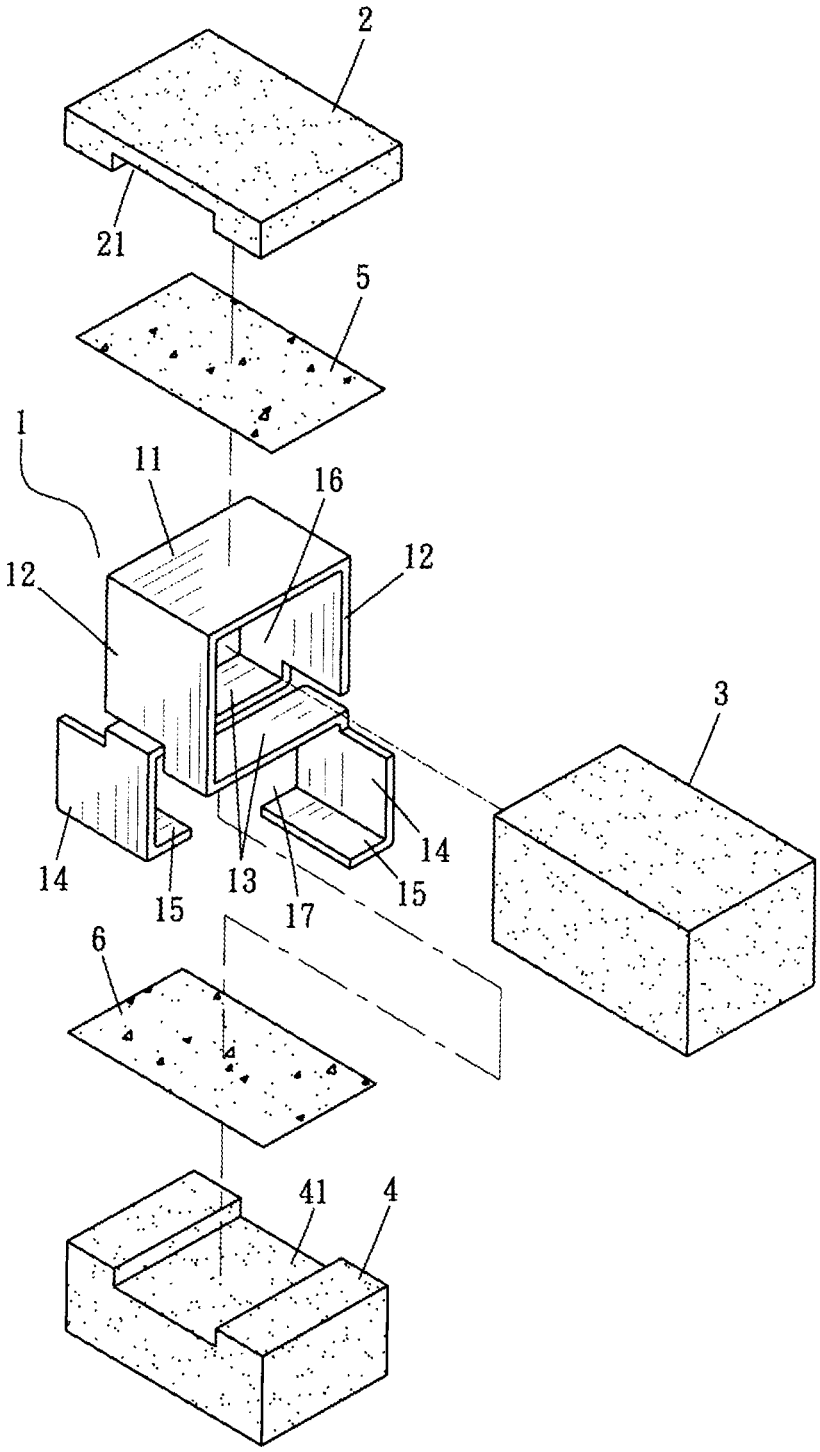
FIG. 1 is an exploded view of a stacked inductor according to a first preferred embodiment of the invention.
Figure 2:
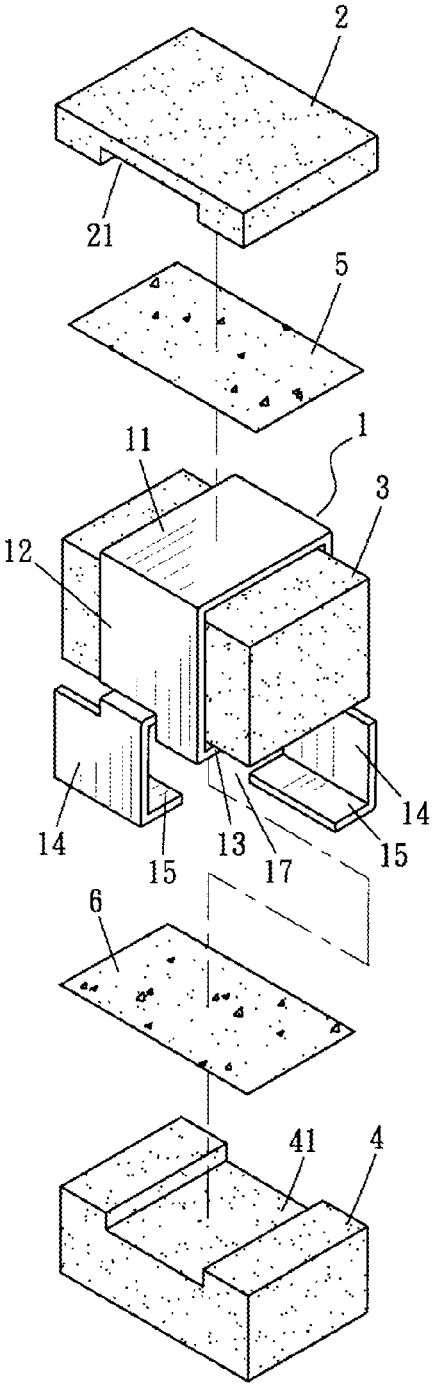
FIG. 2 and FIG. 3 are views showing the assembly of the stacked inductor.
Figure 3:
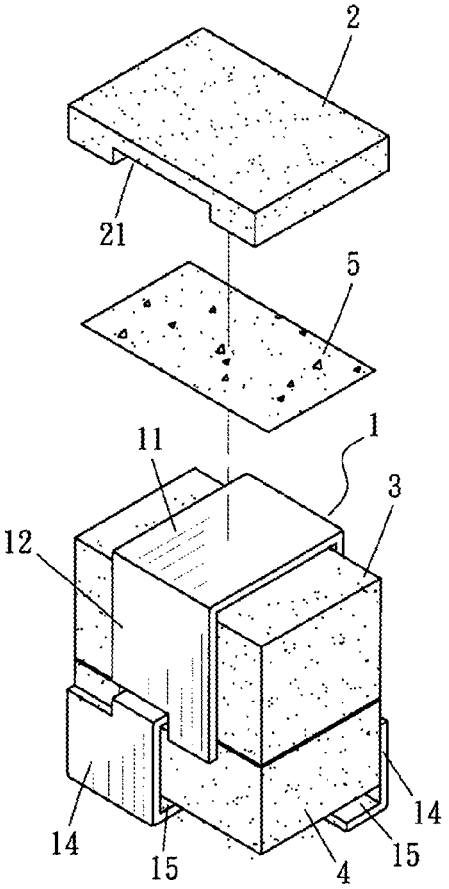
Figure 4:
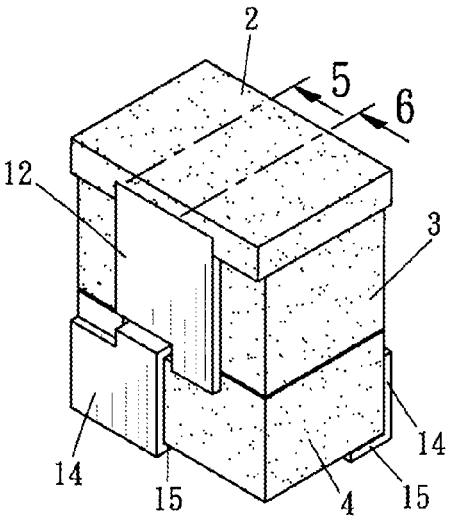
FIG. 4 is a perspective view of the assembled stacked inductor.
Figure 5:
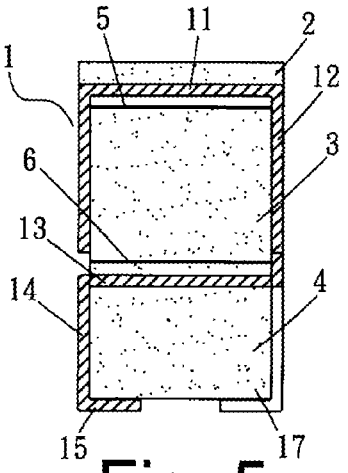
FIG. 5 is a sectional view taken along line 5 of FIG. 4.
Figure 6:
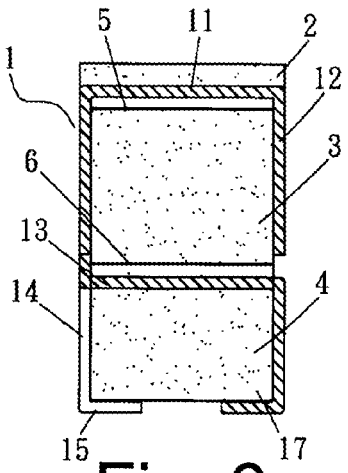
FIG. 6 is a sectional view taken along line 6 of FIG. 4.

Referring to FIGS. 1 to 6, a stacked inductor in accordance with a first preferred embodiment of the invention comprises the following components as discussed in detail below.

A frame 1 is made of copper (or other conductive material) and is formed by molding. The frame 1 comprises a top surface 11, two sides 12 depending downward from both sides of the top surface 11, two spaced bottom surfaces 13 each inward bending about 90-degree from a projecting portion of a bottom of either side 12, an upper space 16 defined by the top surface 11, the sides 12, and the bottom surfaces 13, two vertical, flat legs 14 each depending downward from one end of either bottom surface 13, two rectangular supports 15 each inward bending about 90-degree from a bottom end of either leg 14, and a lower space 17 defined by the bottom surfaces 13, the legs 14, and the supports 15.

An upper core 2 is made of ferromagnetic material and has an inverted U-shaped longitudinal section. The upper core 2 comprises a bottom groove 21. An intermediate core 3 is made of ferromagnetic material and is a parallelepiped. A lower core 4 is made of ferromagnetic material and has a U-shaped longitudinal section. The lower core 4 comprises a top groove 41. A first rectangular member 5 is made of non-ferromagnetic material and a second rectangular member 6 is made of non-ferromagnetic material.

In assembly, the bottom groove 21 of the top core 2 is disposed on the top surface 11, the intermediate core 3 is disposed in the upper space 16, the first rectangular member 5 is disposed between the intermediate core 3 and the top surface 11, the lower core 4 is disposed in the lower space 17 and supported by the supports 15, and the second rectangular member 6 is disposed between the intermediate core 3 and the bottom surfaces 13. Further, glue is used to permanently fasten them together.

Figure 7:
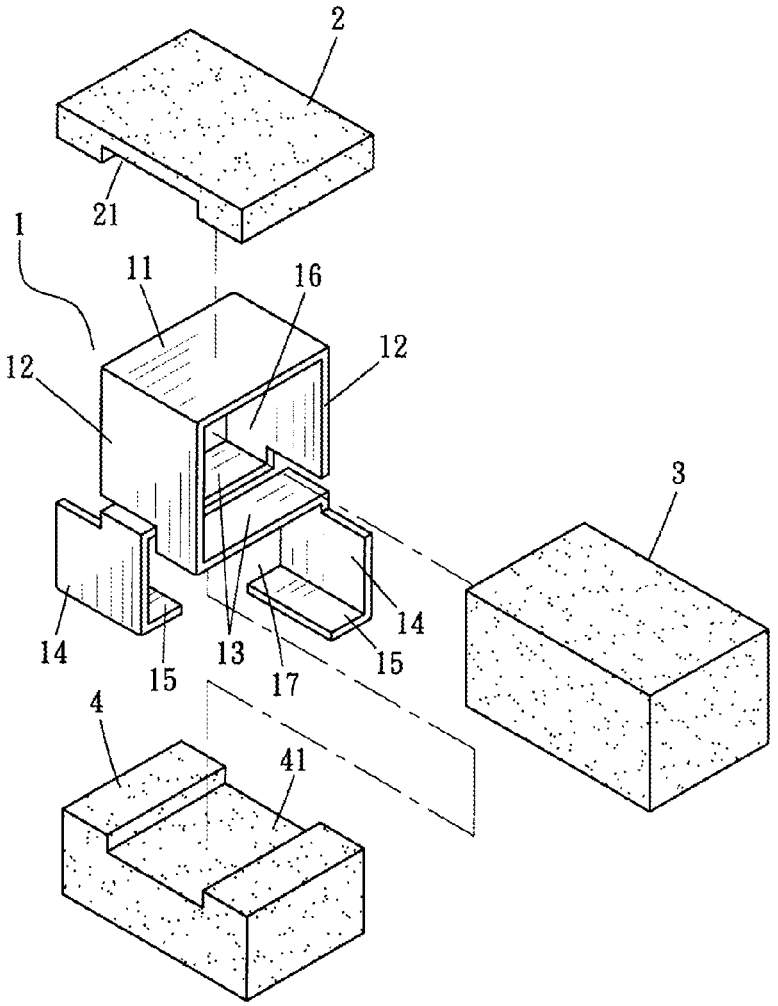
FIG. 7 is an exploded view of a stacked inductor according to a second preferred embodiment of the invention.

Referring to FIG. 7, a stacked inductor in accordance with a second preferred embodiment of the invention is shown. The characteristics of the second preferred embodiment are substantially the same as that of the first preferred embodiment except the following: The first and second rectangular members are eliminated.

It is noted that inductance of the stacked inductor can be controlled by adjusting thickness of one of the first and second rectangular members 5, 6 or both.

It is further noted that the upper core 2, the intermediate core 3, and the lower core 4 are magnetically connected together to form a three-core inductor.

Figure 8:
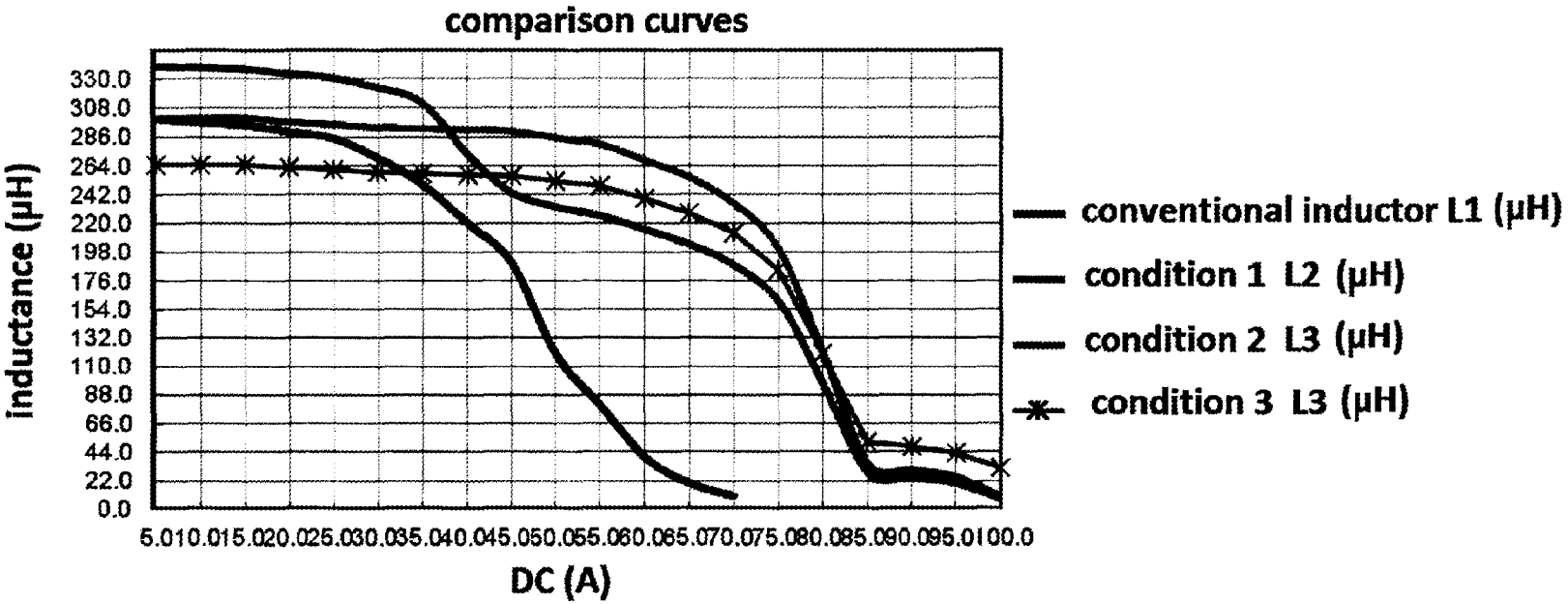
FIG. 8 plots inductor versus DC (direct current) for curves representing conventional inductor, condition 1 of the invention, condition 2 of the invention, and condition 3 of the invention.

Referring to FIG. 8, it shows the following conditions:

Condition 1 of the invention: Two inductors can be used as a single typical inductor when electric current flows through the inductors.

Condition 2 of the invention: Inductance of an inductor is greater in low current. Inductance will be saturated when electric current flowing through the inductor is increased. Thus, the inductance is high in low power. In$|_{[4RB1]}$ductance remains substantially unchanged in high current.

Condition 3 of the invention: Inductance will be saturated when electric current flowing through two inductors. Further, inductance of one of the inductors remains unchanged. Thus, the inductance is high in low power. Inductance remains substantially unchanged in high current to increase stability of the circuit.

It is contemplated by the invention that greater inductance can be obtained and high DC can pass the inductor with low core loss.

While the invention has been described in terms of preferred embodiments, those skilled in the art will recognize that the invention can be practiced with modifications within the spirit and scope of the appended claims.

What is claimed is:

1. A stacked inductor comprising:

a conductive frame including a top surface, two side surfaces depending downward from both sides of the top surface, two spaced bottom surfaces each inward bending about 90-degree from a projecting portion of a bottom of either side surface, an upper space defined by the top surface, the side surfaces, and the bottom surfaces, two vertical legs each depending downward from one end of either bottom surface, two supports each inward bending about 90-degree from a bottom of either leg, and a lower space defined by the bottom surfaces, the legs, and the supports;

an upper core including a bottom groove;

an intermediate core;

a lower core including a top groove;

a first member; and a second member;

wherein the bottom groove of the top core is disposed on the top surface, the intermediate core is disposed in the upper space, the first member is disposed between the intermediate core and the top surface, the lower core is disposed in the lower space and supported by the supports, and the second member is disposed between the intermediate core and the bottom surfaces; and wherein the upper core, the intermediate core, and the lower core are magnetically connected together.

2. A stacked inductor comprising:

a conductive frame including a top surface, two side surfaces depending downward from both sides of the top surface, two spaced bottom surfaces each inward bending about 90-degree from a projecting portion of a bottom of either side surface, an upper space defined by the top surface, the side surfaces, and the bottom surfaces, two vertical legs each depending downward from one end of either bottom surface, two supports each inward bending about 90-degree from a bottom of either leg, and a lower space defined by the bottom surfaces, the legs, and the supports;

an upper core including a bottom groove;

an intermediate core; and a lower core including a top groove;

wherein the bottom groove of the top core is disposed on the top surface, the intermediate core is disposed in the upper space, and the lower core is disposed in the lower space and supported by the supports; and wherein the upper core, the intermediate core, and the lower core are magnetically connected together.

* * * * *